US006829451B2

(12) United States Patent
Ise

(10) Patent No.: US 6,829,451 B2
(45) Date of Patent: Dec. 7, 2004

(54) IMAGE FORMING APPARATUS HAVING AN ELECTRICAL CONNECTION MECHANISM FOR INTERRUPTING POWER TO A MAGNETIC FIELD GENERATING UNIT DRIVING MECHANISM

(75) Inventor: Tokihiko Ise, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,805

(22) Filed: Mar. 20, 2003

(65) Prior Publication Data

US 2004/0184833 A1 Sep. 23, 2004

(51) Int. Cl.[7] ..... G03G 15/00
(52) U.S. Cl. ..... 399/90
(58) Field of Search ..... 399/90, 88, 320, 399/37

(56) References Cited

U.S. PATENT DOCUMENTS 6,359,269 B1 * 3/2002 Hayasaki et al. ..... 219/665

FOREIGN PATENT DOCUMENTS

| | | |
|---|---|---|
| JP | 11-126678 A | 5/1999 |
| JP | 2000-105518 A | 4/2000 |

* cited by examiner

*Primary Examiner*—Quana Grainger
(74) *Attorney, Agent, or Firm*—Foley & Lardner LLP

(57) ABSTRACT

A fixing unit according to the present invention includes a contact provided in the fixing unit, which includes an excitation coil and an excitation circuit, and a terminal connectable with the contact, and interrupts the power supply to the excitation coil, between a commercial power supply and the excitation circuit, when the fixing unit is moved to a predetermined position and the contact is separated from the terminal.

4 Claims, 5 Drawing Sheets

IMAGE FORMING APPARATUS HAVING AN ELECTRICAL CONNECTION MECHANISM FOR INTERRUPTING POWER TO A MAGNETIC FIELD GENERATING UNIT DRIVING MECHANISM

BACKGROUND OF THE INVENTION

The present invention relates to a fixing unit which is used in a copying machine or a printer using toner to fix a toner image, and an image forming apparatus in which the fixing unit is incorporated.

A fixing unit is incorporated in a copying machine which uses an electrophotographic process, to heat and melt a developer or toner formed on a member to be fixed, for example, paper material (non-processed paper), to fix the toner to the piece of paper (paper material). As a well-known method of heating a toner usable in a fixing unit, there is a method of using radiant heat obtained by lighting a filament lamp or a halogen lamp, and a flash heating method using a flash lamp as a heating source. In recent years, a fixing unit which uses an induction heater as a heating source has also been put to practical use. A fixing unit using an induction heater can reduce the time required to heat a heating (fixing) roller or sheet up to a temperature for melting the toner.

In many cases, a heating roller containing a heater inside and a pressing roller pressed by a predetermined pressure to a heating roller or sheet at one point on its outer circumference, are used. In this structure, it is easy to efficiently supply the heat from a heat source to the toner, and to supply a pressure for fixing a melted toner to a piece of paper.

When an induction heater is used as a heat source, a current flowing in an excitation coil reaches several tens of amperes. Thus, when disconnecting the fixing unit or sliding it toward the front of a copying machine by a sliding mechanism to clear a paper jam, or when opening the cover or the like, the power supply to the induction heater must be interrupted. When the power supply to the induction heater cannot be interrupted by a structure, a cover or the like is separately provided to disable the user or operator from touching a current-carrying part.

However, if the unit is constructed to interrupt the power to the induction heater when removing or sliding the fixing unit or opening the cover for maintenance, for example, a drawer connector which can release electrical connection when being slid is used, and a problem of lowering a contact resistance through long-term use rises. This will cause an electrical short-circuit or other defects.

Further, provision of a cover to prevent the user or operator from touching a current-carrying part raises another problem that the shape and structure of the additional cover becomes complex. The additional cover requires an additional cost. If the current-carrying part is formed difficult to be touched by the user or operator, it will be difficult to clear a paper jam, or extremely decrease the workability in maintenance.

BRIEF SUMMARY OF THE INVENTION

It is an object of the present invention to provide a fixing unit and an image forming apparatus, which make it difficult for the user or operator to touch a current-carrying part, and increase the workability in clearing a paper jam and maintenance.

The present invention provides an apparatus which forms an image, comprising:

a recording medium carrying mechanism which carry a material to be transferred and permits fixing of a visualizing agent adhered selectively to an electrostatic image formed on a latent image bearing member, and which move to a predetermined position together with a sliding mechanism;

a recording medium heating unit which supplies a predetermined heat and pressure to the material to be transferred, to which the visualizing agent has been transferred, and the visualizing agent, respectively, and fixes the visualizing agent to the material to be transferred, the recording medium heating unit including a first member made of a material in which an eddy current to be generated, a second member capable of supplying a predetermined pressure to the first member, and a magnetic field generating unit which generates a magnetic field to generate an eddy current in the first member, the recording medium heating unit movable to a predetermined position;

a magnetic field generating unit driving mechanism which supplies a predetermined high-frequency output to the magnetic field generating unit to enable the unit to generate a magnetic field;

a commercial power supply mechanism which supplies a predetermined power used by the magnetic field generating unit driving mechanism to supply the predetermined high-frequency output to the magnetic field generating unit; and an electrical connection mechanism which can interrupt the power from the commercial power supplying mechanism to the magnetic field generating unit driving mechanism, between the commercial power supplying mechanism and the magnetic field generating unit driving mechanism.

The present invention provides an image forming apparatus comprising:

a photoconductor which is selectively exposed with light in the state being electrified to a predetermined electric potential, and holds the potential difference between an exposed part exposed with light and a non-exposed part not exposed with light as a latent image;

a developing unit which supplies toner to the latent image formed on the photoconductor, and makes the image visible;

a recording medium carrying mechanism which carry a recording medium capable of holding the toner non-electrostatically to the photoconductor, and can move to a predetermined position together with a sliding mechanism;

a transfer unit which electrostatically draws the toner to the recording medium carried by the recording medium carrying mechanism toward the photoconductor;

a fixing unit which supplies the recording medium, to which the toner has been transferred by the transfer unit, and the toner, respectively, and fixes the toner to the recording medium, the fixing unit including a first member made of a material in which an eddy current to be generated, a second member capable of supplying a predetermined pressure to the first member, and an excitation circuit which generates a magnetic field to generate an eddy current in the first member, the fixing unit movable to a predetermined position together with a sliding mechanism;

an excitation circuit control unit which sets the frequency of a high-frequency output that the excitation circuit has to output to generate the magnetic field;

a commercial power supply mechanism which supplies a predetermined power used by the excitation circuit control unit to supply the predetermined high-frequency output to the excitation circuit;

a slide type connector which includes a contact and a terminal, and interrupt the power supply from the commercial power supplying mechanism to the excitation circuit control unit, between the commercial power supplying mechanism and the excitation circuit control unit, the contact fixed to a predetermined position in the fixing unit, the terminal fixed to the side where the predetermined power is supplied to the commercial power supplying mechanism; and a cover member which covers the excitation circuit provided in the fixing unit as one body, the cover member openable only when the recording medium carrying mechanism moves to a predetermined area, and while the cover member is being opened, the recording medium carrying mechanism cannot return to the original position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter an image forming apparatus, to which embodiments of the present invention are applicable, will be explained in detail.

Figure 1:
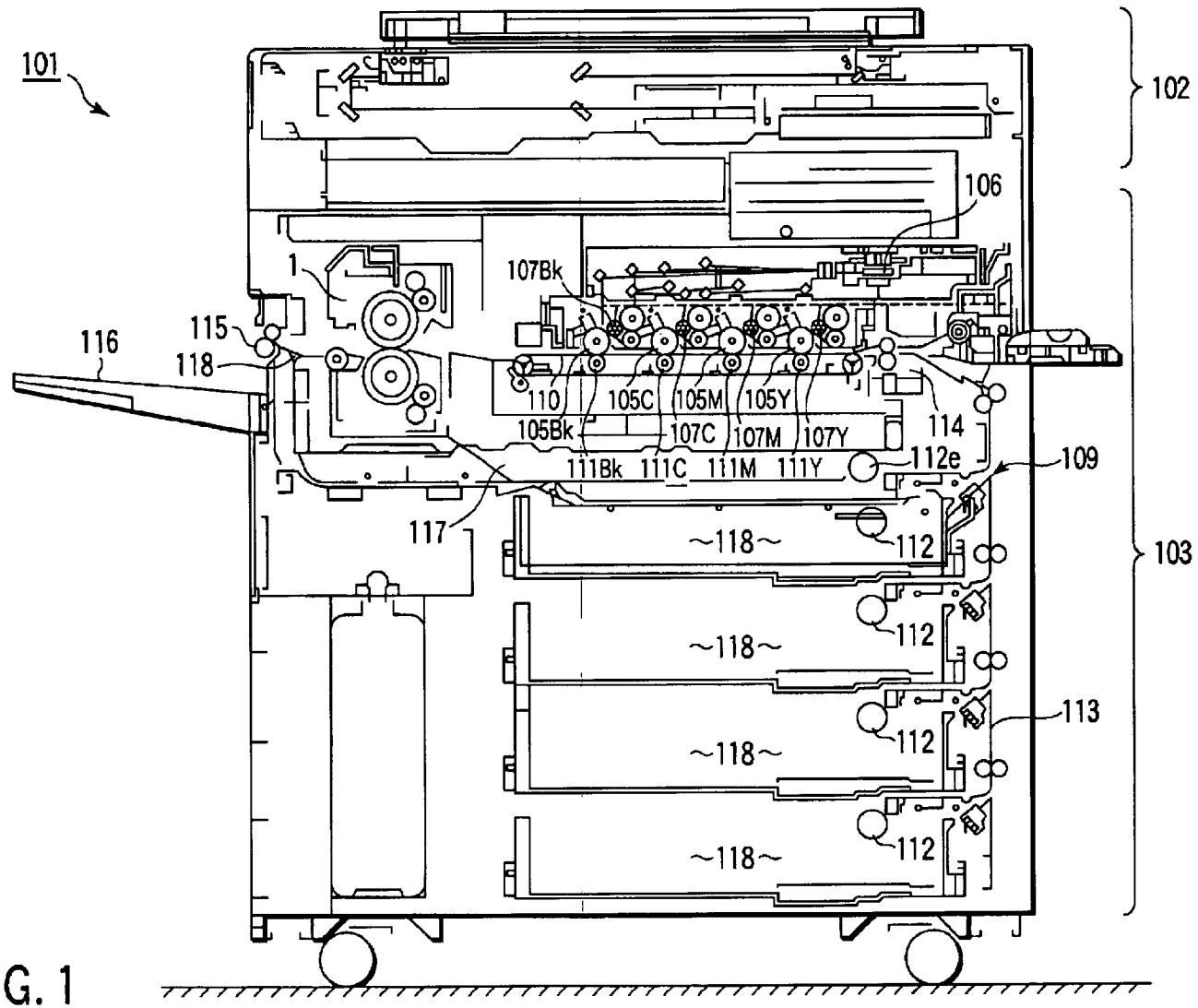
FIG. 1 is a schematic diagram explaining an example of a configuration of an image forming apparatus, to which an embodiment of the present invention is applicable.

As shown in FIG. 1, a digital copying machine (image forming apparatus) 101 includes an image reading unit (scanner) 102 which captures an image of an object as brightness and darkness of light, opto-electrically converts it, and creates an image signal, and an image forming unit 103 which forms an image corresponding to an image signal supplied from the scanner 102 or an external unit, and fixes it to a paper sheet P or a fixing member (material to be transferred).

The image forming unit 103 has first to fourth cylindrical photoconductive drums 105 (Y, M, C and B). Each photoconductive drum 105 (Y, M, C and B) is made cylindrical containing a photoconductor in the outer circumference, which is exposed with light in the state being electrified to a predetermined electric potential, and holds a potential change in the light exposed area as a latent image for a predetermined time.

On each photoconductive drum 105 (Y, M, C and B), the scanner 102 or an external unit exposes through an exposing unit 106 four laser beams whose light intensity is changed corresponding to the image information to be outputted, and four latent images or four images for color image are formed. The four laser beams contain three exposure lights for Y (Yellow), M (Magenta) and C (cyan) images, that is, the color components separated based on subtractive primaries, plus one exposure light for Bk (Black) image to reinforce black.

The images formed on each photoconductive drum 105 (Y, M, C and B) are made visible when they are selectively supplied with proper toner (developer) in a developing unit 107 (Y, M, C and B) containing the toners corresponding to the colors of the images held by each photoconductive drum.

A toner set, i.e. toner image on each photoconductive drum 105 (Y, M, C and B), which is developed by the toner supplied from each developing unit 107 (Y, M, C and B), is transferred to the paper sheet P carried on a transfer belt 110, the paper sheet p is fed from a cassette 108 and through a paper-carrying section 109, explained below. A transfer unit 111 (Y, M, C and B), which is provided at in side of the transfer belt 11 corresponding to each photoconductive drum 105 (Y, M, C and B) supplies a predetermined voltage to transfer each color toner to the paper sheet P, and the toner image transferred to the paper sheet P is carried with the paper sheet P by the transfer belt 110 toward a fixing unit 1, where the toner image is heated and pressed to be fused, and fixed to the paper by the pressure from the fixing unit 1.

Paper sheets P are taken out one by one from an optional cassette 108 by a pickup roller 112, and carried at a predetermined timing on a paper carrying path 113 defined between the transfer belt 110 and cassette 108, up to an aligning roller 114.

The position of the toner image on the paper sheet P formed on a first photoconductive drum 105Y or the position with respect to the reference position of the transfer belt 110 is matched by the aligning roller 114, and the paper sheet P is fed to the transfer position where each drum is opposite to the transfer unit 11.

After being fixed with a toner image in the fixing unit 1, the paper sheet P is fed to an outputting paper tray 116 located at a predetermined position in the image forming apparatus through a paper outputting roller 115. It is also possible to output the image to the back side of the paper sheet P whose front side already has another image, by a reversing unit 117 positioned between each cassette 108 and a carrying belt 100. In this case, the paper sheet P carried once from the fixing unit 1 to the paper outputting roller 115 is guided to the reversing unit 117 by a branching unit 118 immediately before the paper output roller 115. The paper sheet P is guided by the reversing unit 117 (with the image already fixed on one side of the paper) is fed again toward the aligning roller 114 at a predetermined timing by a pickup roller 112*e*.

Figure 3:
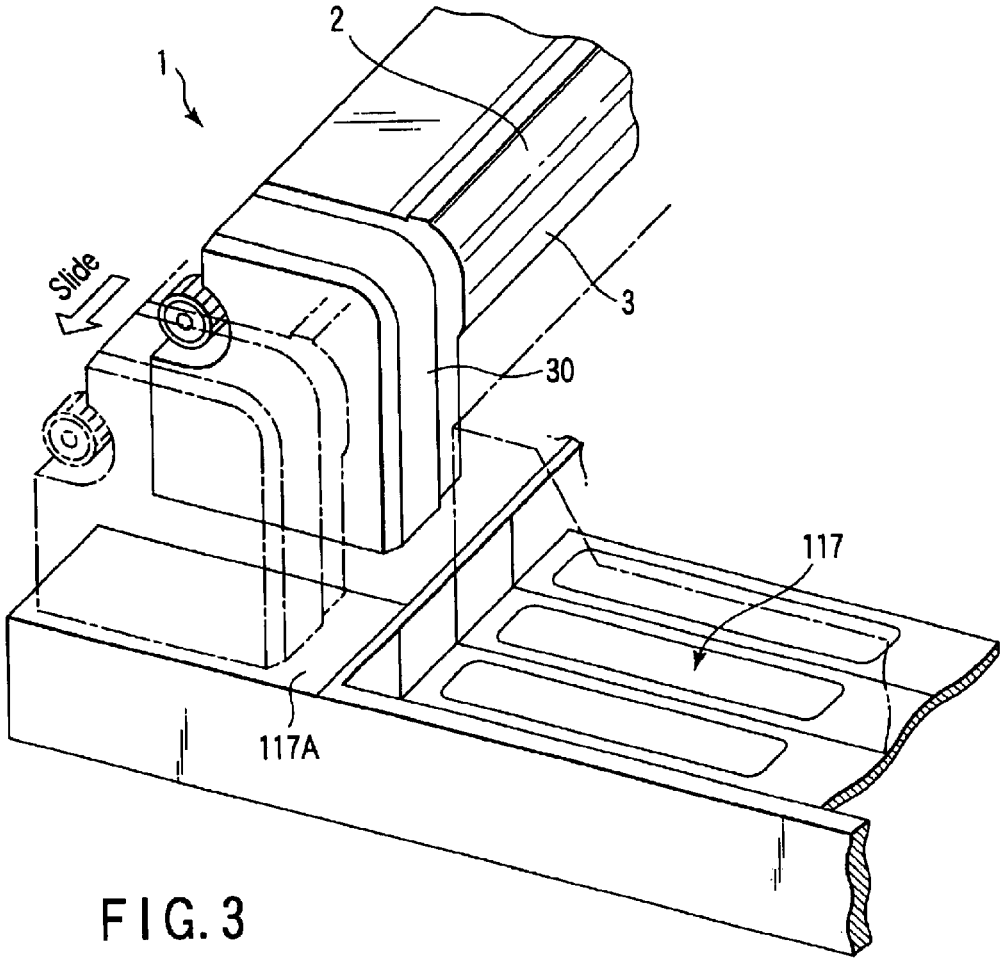
FIG. 3 is a schematic illustration of the fixing unit shown in FIG. 2, drawn out from the image forming apparatus shown in FIG. 1, and seen from the front side.
Figure 4:
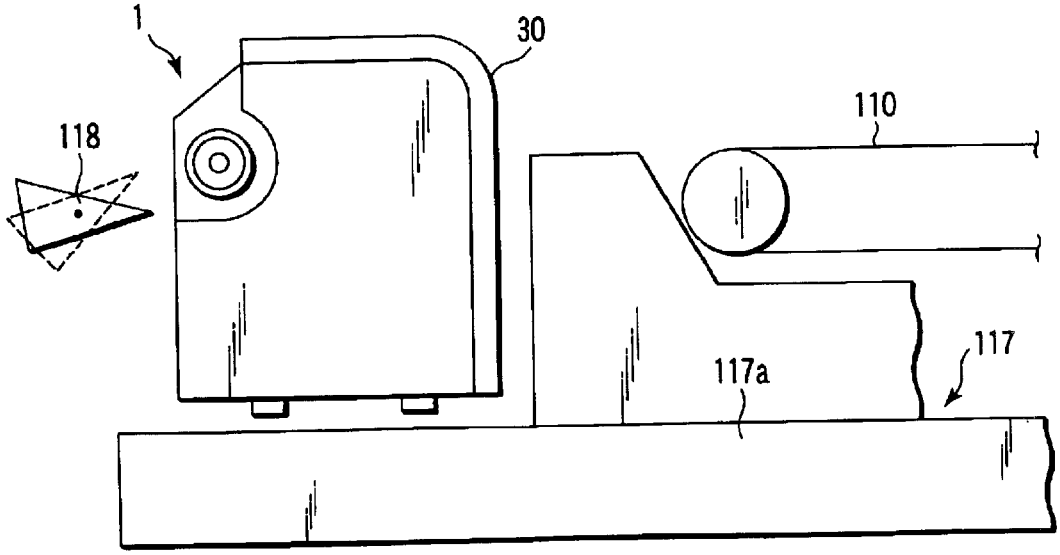
FIG. 4 is a schematic illustration of the fixing unit shown in FIG. 2, seen from the front of the side of a cover covering an excitation unit located in front of the fixing unit.

At the front of the fixing unit 1, an excitation unit, to be explained later with reference to FIGS. 3 and 4, is provided to supply a predetermined high frequency output to the fixing unit 1.

Figure 6:
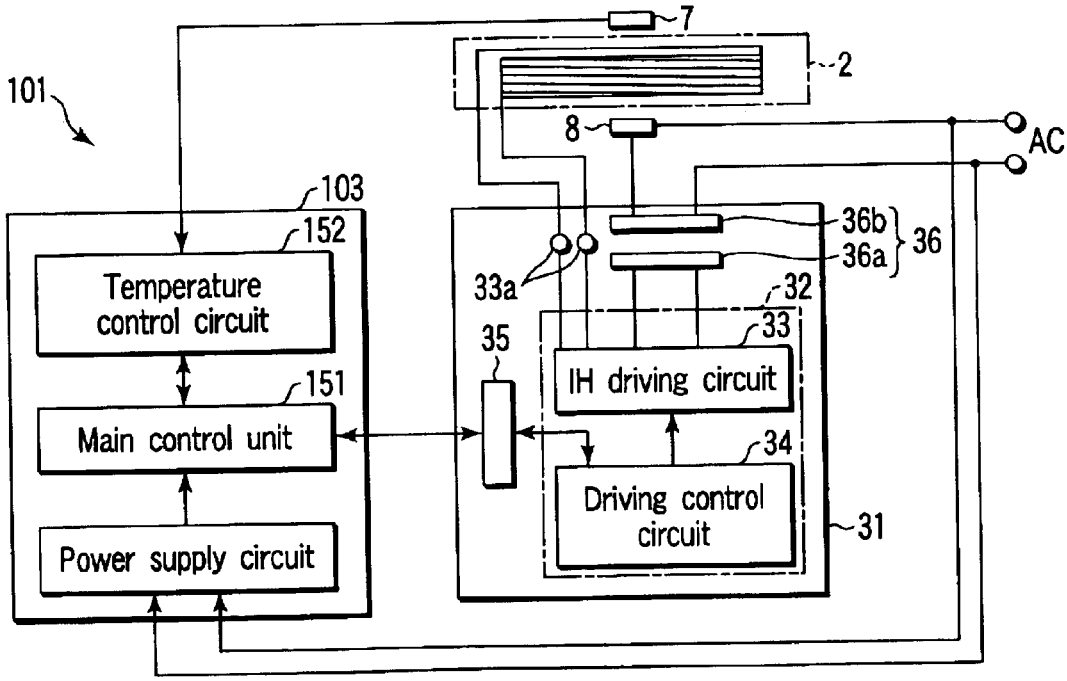
FIG. 6 is a schematic block diagram explaining an example of a control system to increase the temperature of the fixing unit shown in FIGS. 2 to 5, to a predetermined temperature.
Figure 7:
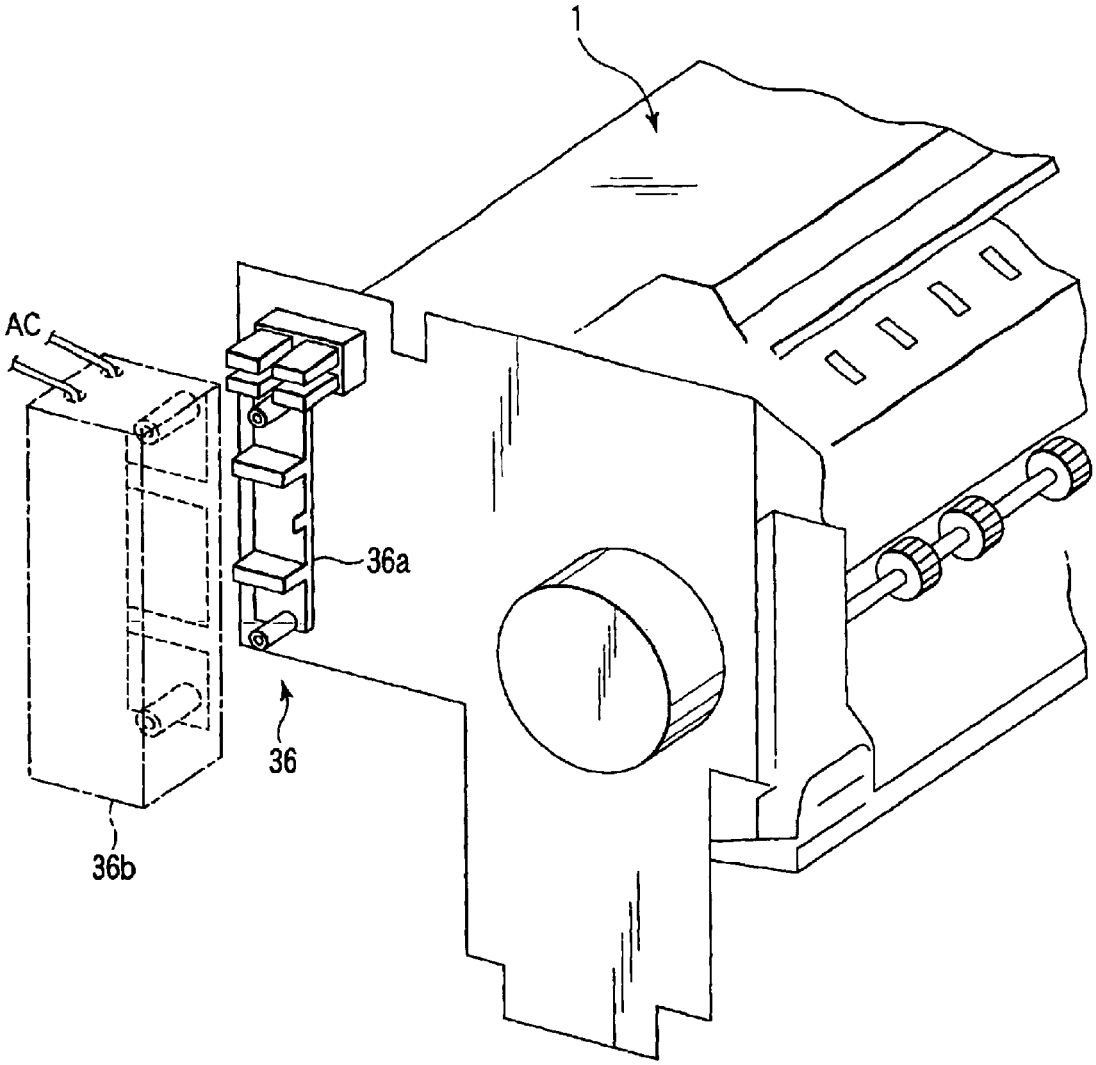
FIG. 7 is schematic illustration of the fixing unit shown in FIGS. 2 to 5, drawn out from the image forming apparatus shown in FIG. 1, and seen from the rear side of the fixing unit.

When a paper jam occurs in the fixing unit 1 and the user draws out the fixing unit 1 from the image forming unit 103, the commercial AC power supply to the excitation unit is interrupted by a drawer connector provided at the rear of the image forming unit 103 (refer to FIGS. 6 and 7). On the other hand, when the operator opens the cover of the excitation unit of the fixing unit 1 for maintenance, the reversing unit 117 must also be drawn out from the image forming unit 103, so as to enable the operator to use a special tool to open the cover of the fixing unit 1, as explained later with reference to FIG. 5. Namely, when a paper jam occurs in the fixing unit 1, the connection of commercial AC power to the excitation unit is released at the time when the user draws out the fixing unit from the image forming unit 103. When the operator opens the cover of the excitation unit for maintenance, the reversing unit 117 cannot be housed in a predetermined position unless the operator sets the cover to the original state, preventing mistakes such as forgetting to close the cover or finishing the work without housing the reversing unit 117.

Figure 2:
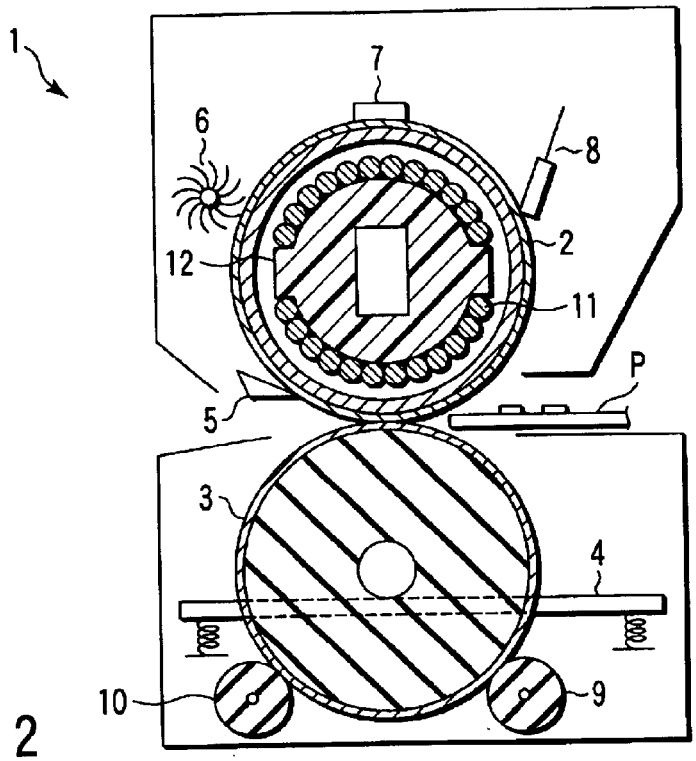
FIG. 2 is a schematic diagram explaining an example of an induction heater type fixing unit applicable to the image forming apparatus shown in FIG. 1.

FIG. 2 is a schematic diagram explaining an example of a fixing unit applicable to the image forming apparatus shown in FIG. 1.

A fixing unit 1 includes a heating (fixing) roller 2 with a diameter of about 60 mm, and a pressure roller 3 with a diameter of about 60 mm.

The heating roller is made of a metal with a thickness of about 2 mm; an iron cylinder in this example. On the surface of the heating roller 2, a not shown releasing layer is formed by depositing a fluoric resin such as polytetrafluoroethylene (Teflon®), for example, to a predetermined thickness. As a material of the heating roller, stainless steel, aluminum or alloy of stainless steel and aluminum can be used. The length of the heating roller 2 is about 340 mm in this example. It is possible to replace the heating roller 2 by a metallic film, which is made by depositing a metal to a predetermined thickness on the surface of a highly heat-resistant resin film sheet, and making it like an endless-belt.

The pressure roller 3 is an elastic roller made by covering the shaft of a predetermined diameter with silicon rubber, or fluoric rubber, to a predetermined thickness. The pressure roller 3 is about 320 mm long.

The pressure roller 3 is substantially parallel to the shaft of the heating roller 2, and pressed by a predetermined pressure to the shaft of the heating roller 2 by a pressing mechanism 4. Thus, a part of the outer circumference of the heating roller 3 is elastically deformed, and a predetermined nip is defined between the two rollers. When a metallic film is used instead of the fixing roller 2, a nip may be formed in the film.

The heating roller 2 is rotated at an almost constant speed by a not-shown fixing motor or a not-shown drum motor which rotates each photoconductive drum 105.

As the pressing roller 3 is made to contact the heating roller 2 by a predetermined pressure by the pressing mechanism 4, when the heating roller 2 is rotated, the pressing roller 3 is rotated at a constant speed of moving its own outer circumference at the same speed of moving the outer circumference of the heating roller 2.

On the circumference of the heating roller 2, on the downstream of the nip (contact point) between the heating roller 2 and pressing roller 3 in the direction of rotation of the roller 2, and at a predetermined position close to the nip, a separation claw 5 which separates the paper sheet P from the heating roller 2 passed through the nip is provided.

Around the heating roller 2, a cleaning mechanism 6, a thermistor 7 and a thermostat 8 are provided, in the rotation direction of the roller 2, and in the direction away from the separation claw 5.

The cleaning mechanism 6 is used to eliminate any (clean) toner remaining on the heating roller 2 or dust from paper, and at the same time, to apply a releasing agent (e.g., silicon oil) to reduce the toner fixed to the releasing layer of the heating roller 2. The thermistor 7 is used to detect the temperature of the surface of the roller 2. The thermostat 8 interrupts the input of commercial AC power, when the excitation coil, to be explained below, is abnormally heated or when the thermistor 7 is damaged.

On the outer circumference of the pressing roller 3, there are provided an oil roller 9 which applies the releasing agent or silicon oil to the circumference surface of the pressing roller 3, and a cleaning roller 10 which eliminates the toner adhered to the circumference surface of the pressing roller 3.

Inside of the heating roller 2, an excitation coil 11 which generates an eddy current in the material of the roller 2 is provided.

The excitation coil 11 has a length capable of heating the width contacting the outer circumference of the roller 2, when paper of A4 size is fed with the short side parallel to the shaft of the roller 2.

The excitation coil 11 is formed by a plurality of wire materials such as copper wires with the diameter of 0.5 mm, for example, insulated each other by heat-resistant polyamide, a bundle of 16 litz wires in this example.

By forming the excitation coil 11 by a litz wire, the diameter of each wire of the excitation coil 11 can be reduced below the penetration depth of the skin effect generated when a high-frequency AC current flows in the wire, and it is possible to efficiently flow a high frequency current in the coil.

The excitation coil 11 is an air core coil fixed to a coil holder 12 made of engineering plastic or a ceramic, providing high heat-resistance and high insulation.

The coil holder 12 can also be made of PEEK (poly ether ether ketone), a phenol or unsaturated polyester.

The method of winding a wire material of the excitation coil 11 is optional. In the example shown in FIG. 2, a coil formed flat is wound around the coil holder 12, along the inner circumference of the heating roller 2.

FIG. 3 is a schematic illustration of the fixing unit shown in FIG. 2, drawn out from the image forming apparatus shown in FIG. 1, and seen from the front side. FIG. 4 is a schematic illustration of the fixing unit shown in FIG. 2, seen from the front of the side of a cover covering an excitation unit located in front of the fixing unit.

As shown in FIGS. 3 and 4, in the front of the fixing unit 1, a front cover 30, openable by turning in a predetermined direction, for example, is provided. Inside of the front cover 30, a circuit board 31 including the excitation unit (refer to FIG. 5) to supply a predetermined high-frequency output to the excitation coil 11 (not seen in the heating roller 2, refer to FIG. 2), is arranged. Even if the fixing unit 1 is drawn out to a predetermined position, the space necessary to open the front cover 30 of the fixing unit 1 is excluded by a front cover 117A of the reversing unit 117. When the fixing unit 1 is drawn out to the position shown in FIG. 3, the connection of commercial power to the circuit board 31 capable of supplying a predetermined high-frequency output to the excitation coil 11 of the fixing unit 1, is released.

Figure 5:
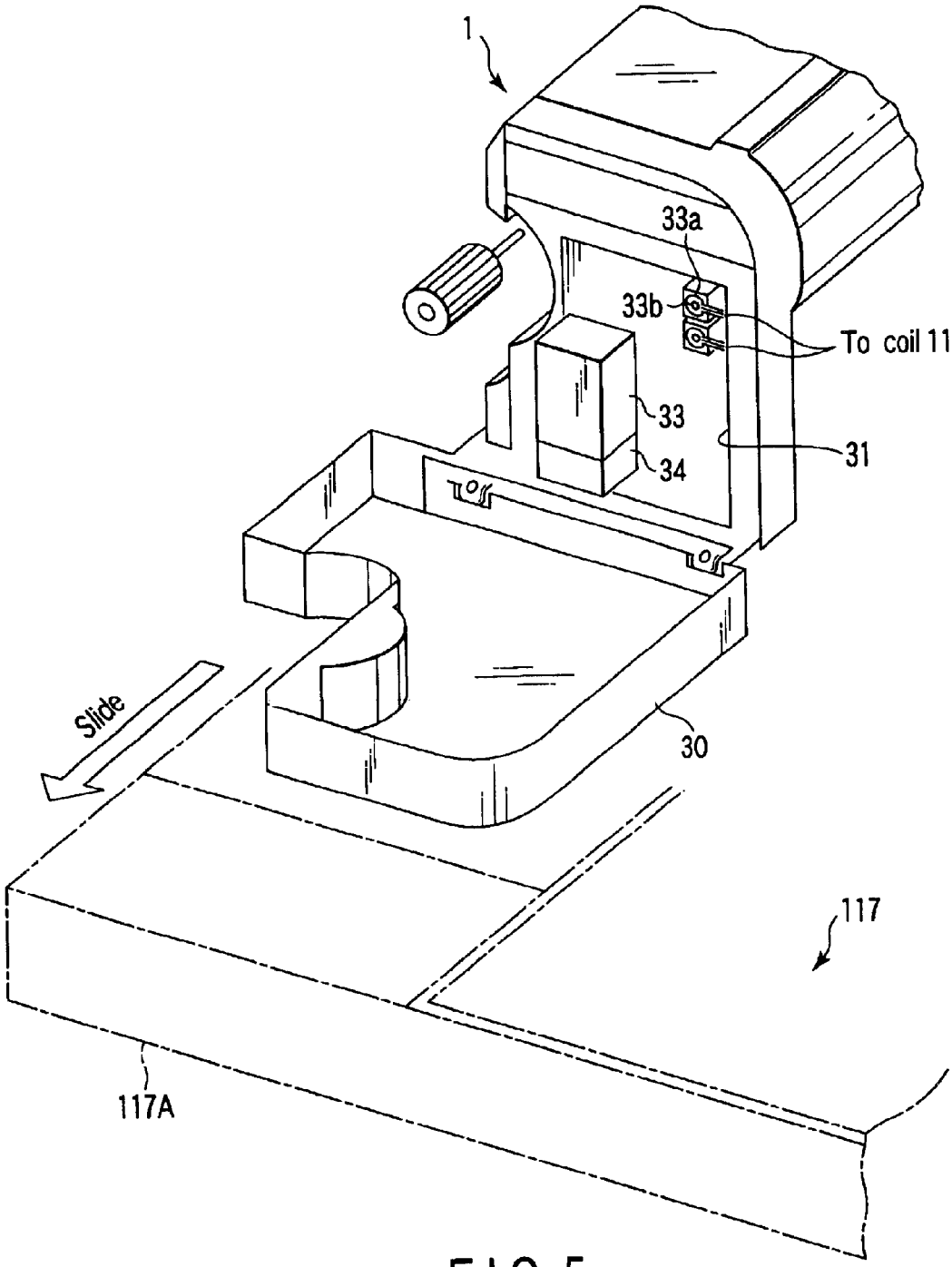
FIG. 5 is a schematic illustration of the fixing unit shown in FIG. 2, drawn out from the image forming apparatus, with the cover covering the excitation unit opened in front of the fixing unit.

FIG. 5 shows the fixing unit with the front cover opened when the reversing unit is drawn out from the image forming apparatus by separating the drawer connector to be explained later (refer to FIGS. 6 and 7 from the image forming unit 103.

As shown in FIG. 5, when the front cover 30 of the fixing unit 1 is opened, a predetermined part of the reversing unit 117, for example, the cover 117A comes in contact with the front cover 30. Therefore, the fixing unit 1 cannot be housed in the original position, if the reversing unit 117 is not housed in the original position prior to the fixing unit 1.

When the front cover 30 is opened, the operator can touch the circuit board 31 including the excitation unit for maintenance, for example. The excitation coil 11 and excitation unit 32 which supplies the excitation coil with a predetermined high-frequency output, are connected not by a connector that can be electrically separated with ease, but connected semipermanently by a terminal with a stopper ring (O-terminal) or U-shape terminal 33*a* and a screw 33*b*.

Namely, even if the fixing unit 1 is repeatedly drawn out from or housed in the image forming unit 103, the contact resistance at the contact point will not be lowered. Further, the terminal with a stopper ring or U-shape terminal 33*a* is crimped by caulking to the end of the excitation coil 11 or the leader wire (electric wire) connected to the excitation coil 11.

Therefore, the predetermined high-frequency output to the excitation coil 11 in which a current of several tens of amperes flows, does not pass through the easily-separable drawer connector, and the connector does not need to meet special standards, and a cheap ordinary type connector can be used.

FIG. 6 is a schematic block diagram explaining an example of a control system to operate the fixing unit shown in FIGS. 2 to 5.

Inside of the heating roller 2 of the fixing unit 1, the excitation coil 11 which generates an eddy current in the material of the roller 2 is housed, as explained before.

The excitation coil 11 is connected with the excitation unit 32 of the circuit board 31 which supplies a predetermined high-frequency output to the excitation coil 11.

The excitation unit 32 includes an IH driving circuit 33 capable of outputting a predetermined high-frequency output to both ends of the excitation coil 11, and a drive control unit 34. The IH drive circuit 33 once converts the AC voltage received from a commercial AC power supply to a DC voltage by a not-shown rectifier circuit under the control of the driving control unit 34, and supplies it to the excitation coil 11 as a predetermined high-frequency output.

The drive control unit 34 is connected to a main control unit 151 of the image forming unit 103 through an optical interface 35. The drive control unit 34 sets the frequency of a high-frequency signal which the IH driving circuit 33 is to output according to the control signal received from the image forming unit 103.

The main control unit 151 of the image forming unit 103 sets, by a temperature control circuit 152, the temperature information that is an element to set the high-frequency output set by the drive control unit 34, based on the output of the thermistor 7 that is the output of detecting the circumference temperature of the heating roller 2, and supplies the temperature information to the drive control circuit 33.

The drawer connector 36 capable of connecting a commercial AC power to the circuit board 31 contributes to disconnect from the commercial AC power, but does not contribute to disconnect the excitation coil 11 from the IH driving circuit 33, as explained before.

FIG. 7 is schematic illustration of the fixing unit shown in FIGS. 2 to 5, drawn out from the image forming apparatus shown in FIG. 1, and seen from the rear side of the fixing unit.

The drawer connector 36 includes a contact 36*a* fixed to the fixing unit 1, and a terminal 36*b* fixed to the image forming unit 103.

The part of the circuit separated by the drawer connector 36 is the part where a commercial AC power is supplied to the IH driving circuit 33 on the circuit board 31, as explained above with reference to FIG. 6, and it does not separate the excitation coil 11 and IH driving circuit 33.

Therefore, even if the fixing unit 1 is repeatedly drawn out from the image forming unit 103, the insulation resistance of the terminal of the drawer connector 36 will not lower and the electric insulation will not degrade.

The excitation unit including the IH driving circuit 33 is not necessarily located in front of the fixing unit 1, but may be located close to the drawer connector 36 shown in FIG. 7, for example. Although it is not shown, the drawer connector 36 can be provided at any optional location other the rear of the fixing unit 1. Namely, it is also possible to provide the drawer connector 36 at a location not seen from the user (of course, it is rare to be touched by the user), though the workability in maintenance is a little degraded. For example, the drawer connector 36 can also be provided in an optional space between the fixing unit 1 and reversing unit 117.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a photoconductor which is selectively exposed with light in the state being electrified to a predetermined electric potential, and holds a potential difference between an exposed part exposed by light and a non-exposed part not exposed by light as a latent image;

a developing unit which supplies toner to the latent image formed on the photoconductor, and makes the image visible;

a recording medium carrying mechanism which carries a recording medium capable of holding the toner non-electrostatically to the photoconductor, and moves to a predetermined position together with a sliding mechanism;

a transfer unit which electrostatically draws the toner to the recording medium carried by the recording medium carrying mechanism toward the photoconductor;

a fixing unit which supplies the recording medium, to which the toner has been transferred by the transfer unit, and the toner, respectively, and fixes the toner to the recording medium, the fixing unit including a first member made of material in which an eddy current can be generated, a second member capable of supplying a predetermined pressure to the first member, and an excitation circuit which generates a magnetic field to generate an eddy current in the first member, the fixing unit movable to a predetermined position together with a sliding mechanism;

an excitation circuit control unit which sets the frequency of a high-frequency output that the excitation circuit has to output to generate the magnetic field;

a commercial power supplying mechanism which supplies a predetermined power used by the excitation circuit control unit to supply the predetermined high-frequency output to the excitation circuit;

a slide type connector which includes a contact and a terminal, and can interrupt the power supply from the commercial power supplying mechanism to the excitation circuit control unit, between the commercial power supplying mechanism and the excitation circuit control unit, the contact fixed to a predetermined position in the fixing unit, the terminal fixed to the side where the predetermined power is supplied to the commercial power supplying mechanism; and a cover member which covers the excitation circuit provided in the fixing unit as one body, the cover member openable only when the recording medium carrying mechanism moves to a predetermined area, and while the cover member is being opened, the recording medium carrying mechanism cannot return to the original position.

2. The image forming apparatus according to claim 1, wherein the slide type connector interrupts the commercial power supply from the commercial power supplying mechanism to the excitation circuit control unit, between the commercial power supplying mechanism and the excitation circuit control unit, when the fixing unit is moved to the predetermined position.

3. The image forming apparatus according to claim 1, wherein the excitation circuit of the fixing unit is semipermanently connected to the excitation circuit control unit.

4. The image forming apparatus according to claim 3, wherein the semipermanent connection is achieved by fixing the terminal crimped to the end of the excitation circuit to the excitation circuit control mechanism by a screw.

* * * * *